US009118106B2

(12) United States Patent
Adams

(10) Patent No.: US 9,118,106 B2
(45) Date of Patent: Aug. 25, 2015

(54) VARIABLE ORIENTATION ANTENNA PLATFORM

(75) Inventor: Debra Kay Adams, Kent, WA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 17 days.

(21) Appl. No.: 13/414,001

(22) Filed: Mar. 7, 2012

(65) Prior Publication Data

US 2013/0233983 A1 Sep. 12, 2013

(51) Int. Cl.
*H01Q 1/12* (2006.01)

(52) U.S. Cl.
CPC . *H01Q 1/125* (2013.01); *H01Q 1/12* (2013.01)

(58) Field of Classification Search
CPC ..... H01Q 1/12; H01Q 1/1228; H01Q 1/1235; H01Q 1/1242; H01Q 1/125; A47G 33/12; A47G 33/126; F16G 11/06; E04H 12/2253; E04H 12/2261; E04H 12/2284
USPC ..... 248/511, 519, 523, 188.1, 521, 522, 248/349.1; 343/880, 882, 890–892; D14/238
See application file for complete search history.

(56) References Cited

U.S. PATENT DOCUMENTS

| | | | | | |
|---|---|---|---|---|---|
| 2,474,250 | A * | 6/1949 | Howard | 52/114 |
| 3,714,660 | A * | 1/1973 | Scrafford et al. | 343/757 |
| 4,146,897 | A * | 3/1979 | Wilson et al. | 343/882 |
| 4,185,288 | A * | 1/1980 | Dosch et al. | 343/765 |
| 4,404,565 | A * | 9/1983 | Gurney et al. | 343/881 |
| 4,799,642 | A * | 1/1989 | Wright | 248/516 |
| 5,233,809 | A * | 8/1993 | Gropper | 52/150 |
| 5,363,116 | A * | 11/1994 | Allen | 343/881 |
| 5,614,918 | A * | 3/1997 | Dinardo et al. | 343/882 |
| 5,787,673 | A * | 8/1998 | Noble | 52/848 |
| 5,852,423 | A * | 12/1998 | Hughes | 343/765 |
| 5,954,305 | A * | 9/1999 | Calabro | 248/219.4 |
| 5,961,092 | A * | 10/1999 | Coffield | 248/539 |
| 5,979,844 | A * | 11/1999 | Hopkins | 248/158 |
| 6,052,092 | A * | 4/2000 | Davis et al. | 343/757 |
| 6,088,002 | A * | 7/2000 | Johnson et al. | 343/878 |
| 6,215,453 | B1 * | 4/2001 | Grenell | 343/840 |
| 6,229,497 | B1 * | 5/2001 | McCracken | 343/878 |
| 6,563,475 | B2 * | 5/2003 | Ianello et al. | 343/890 |
| 6,710,751 | B2 * | 3/2004 | Ianello et al. | 343/890 |
| 7,642,988 | B1 * | 1/2010 | Johnson et al. | 343/878 |
| 8,669,915 | B2 * | 3/2014 | Wilkinson et al. | 343/872 |
| 2011/0128196 | A1 * | 6/2011 | Sakata et al. | 343/703 |
| 2011/0279347 | A1 * | 11/2011 | Pass et al. | 343/890 |
| 2013/0233983 | A1 * | 9/2013 | Adams | 248/158 |

* cited by examiner

*Primary Examiner* — Jonathan Liu
*Assistant Examiner* — Guang H Guan

(57) ABSTRACT

An antenna platform may include a support structure having a plurality of junctions configured to receive and connect at least two of a plurality of supports. At least one inner support may extend inwardly with respect to the support structure from one of the junctions to a center support. The center support may have a post and a base wherein the post may be configured to receive the at least one inner support extending from the support structure. The base may include a first portion and a second portion, the first portion being fixed to the post and rotatable with respect to the second portion. Upon rotating the first portion, the support structure may also be rotated via the at least one inner support connected to the post.

20 Claims, 5 Drawing Sheets

VARIABLE ORIENTATION ANTENNA PLATFORM

BACKGROUND

Platform structures may be configured to support cellular antennas. These structures may be attached to surfaces, such as building roofs at a cellular site. These structures may be permanently or semi-permanently attached to such the surface, making them difficult to adjust once installed. To modify an existing structure, certain zoning and leasing or usage issues must generally be resolved, as well as the coordination of multiple contractors and service personal.

BRIEF DESCRIPTION OF THE DRAWINGS

While the claims are not limited to the illustrated examples, an appreciation of various aspects is best gained through a discussion of various examples thereof. Referring now to the drawings, illustrative examples are shown in detail. Although the drawings represent the various examples, the drawings are not necessarily to scale and certain features may be exaggerated to better illustrate and explain an innovative aspect of an example. Further, the examples described herein are not intended to be exhaustive or otherwise limiting or restricting to the precise form and configuration shown in the drawings and disclosed in the following detailed description. Exemplary illustrations of the present invention are described in detail by referring to the drawings as follows.

DETAILED DESCRIPTION

Figure 1:
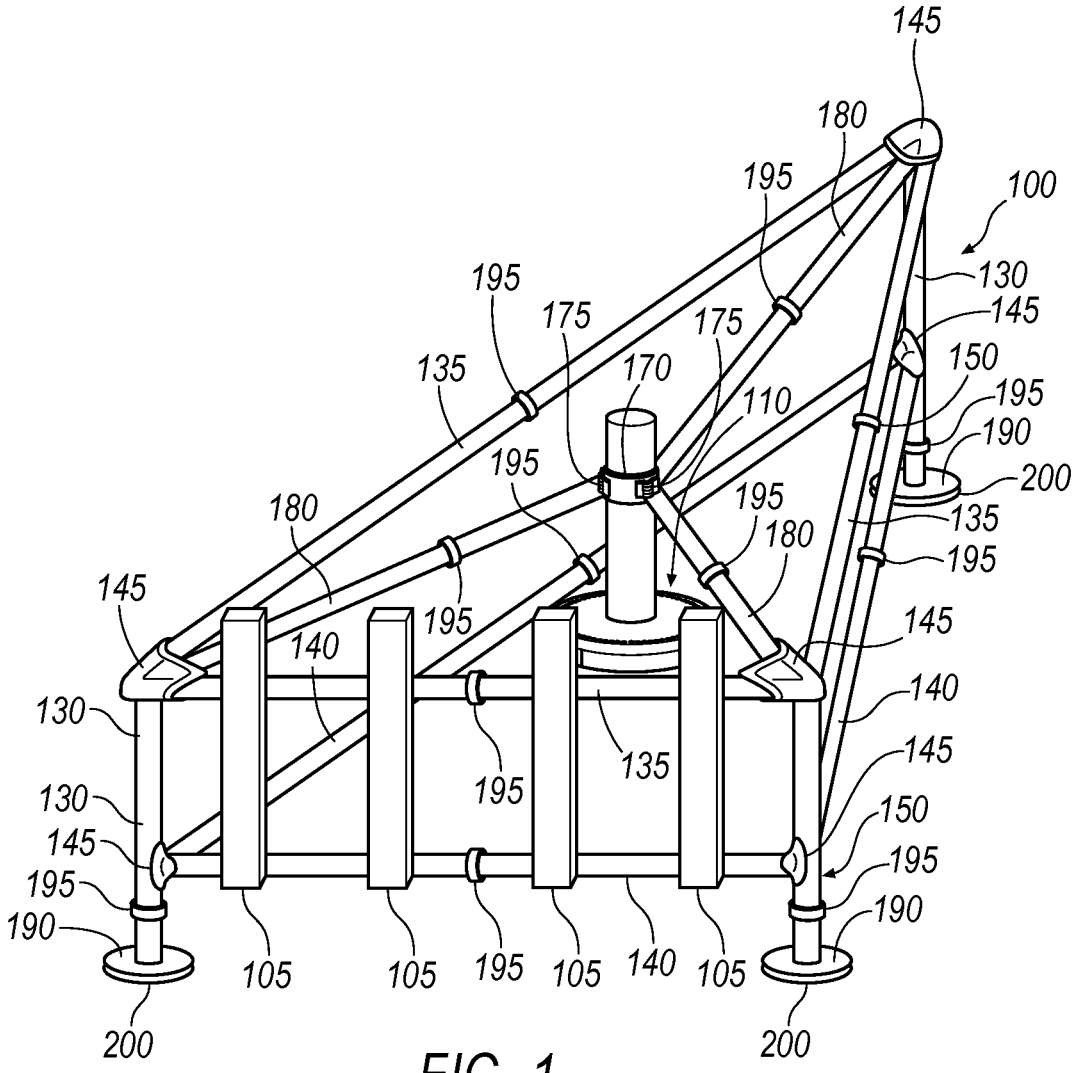
FIG. 1 is an exemplary antenna platform showing antennas attached thereto.

Referring now to the discussion that follows and also to the drawings, illustrative approaches to the disclosed apparatuses and methods are shown in detail. Although the drawings represent some possible approaches, the drawings are not necessarily to scale and certain features may be exaggerated, removed, or partially sectioned to better illustrate and explain the disclosed device. Further, the descriptions set forth herein are not intended to be exhaustive or otherwise limit or restrict the claims to the precise forms and configurations shown in the drawings and disclosed in the following detailed description.

An exemplary antenna platform for supporting at least one antenna may include a center support having a post and base. The platform may be configured to be placed on a surface such as a building roof to maintain the antenna in a fixed position. The center support may be configured to rotate the entire antenna platform so that the antennas connected thereto may be appropriately positioned. The antenna platform may include a support structure including various vertical and lateral supports for maintaining the antennas. Each of these supports may have an adjustable length, allowing the shape and elevation of the structure to be altered even after the platform has been placed on the surface. By adjusting the length, the orientation of the antenna fixed to the platform may be adjusted. Thus, the antenna platform may be a flexible, non-rigid structure that is easily adjustable once placed on a respective surface.

Figure 2:
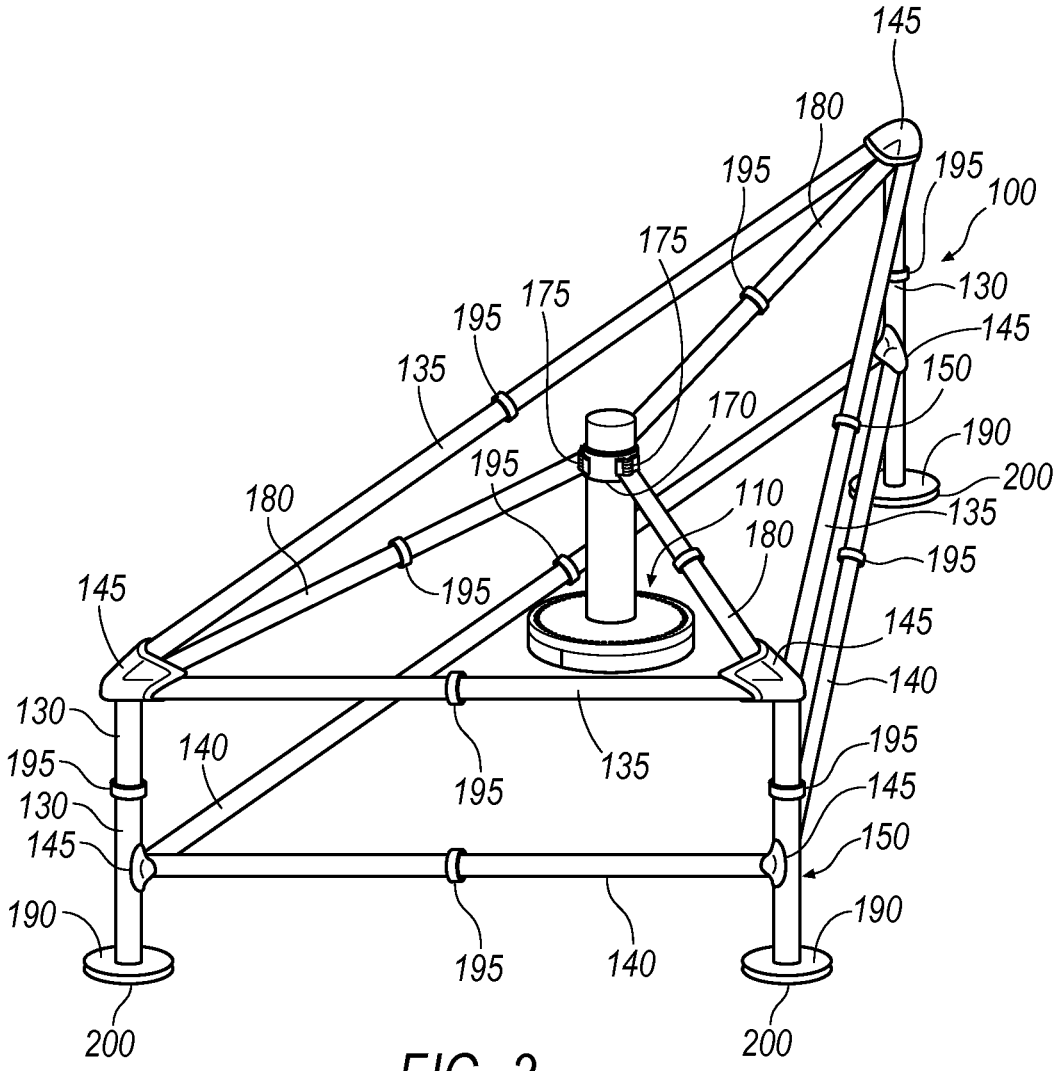
FIG. 2 is another exemplary antenna platform without antennas attached thereto.
Figure 3:
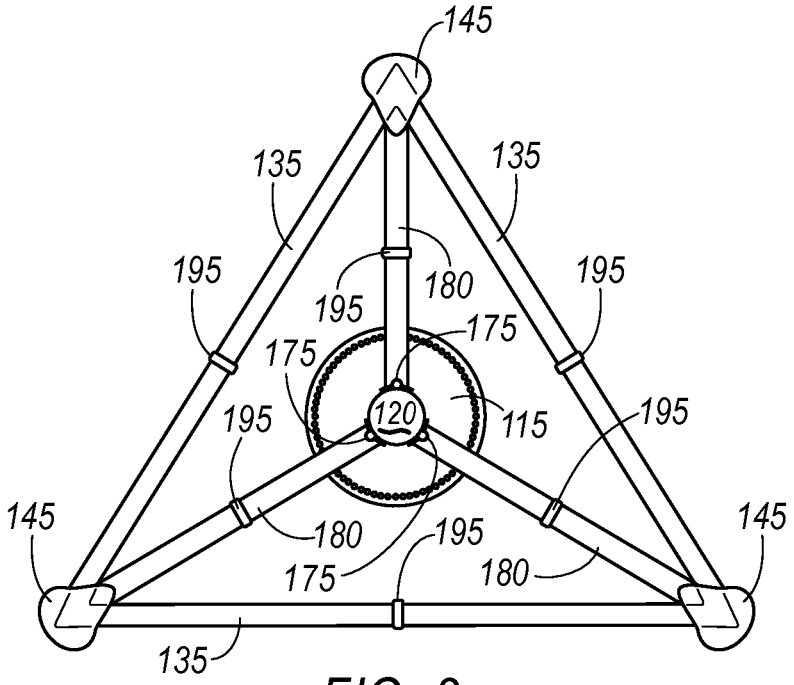
FIG. 3 is a top view of the exemplary antenna platform of FIG. 2.

Referring to FIGS. 1, 2 and 3, an antenna platform 100 for supporting a plurality of antennas 105 is shown. The antenna platform 100 may include a center support 110 having a base 115 and post 120 extending therefrom. The center support 110 is described in more detail with respect to FIG. 4. The antenna platform 100 may include a plurality of vertically extending supports 130 disposed radially outward of the center support 110. In an exemplary illustration, three vertical supports 130 are shown, each being at least generally parallel to center support 110. The vertical supports 130 may extend around and in an exemplary approach at least generally parallel to the post 120 of the center support 110. A first lateral support 135 may extend between each two of the vertical supports 130 thereby connecting at least two of the vertical supports 130 together. A corresponding second lateral support 140 may also extend between each two of the vertical supports 130, extending parallel and spaced from the first supports 135. Lateral supports 135, 140 may extend generally perpendicular to vertical supports 130 in some cases and at an angle in other cases. In one possible approach, if the vertical supports 130 are in the range of between approximately eight to twelve (8 to 12) feet in height, the first and second supports 135, 140 may be between ten and fourteen (10 and 14) feet in length. The lengths of supports 130 as compared to supports 135, 140 may be in a corresponding ratio to the example above if the lengths of one set of supports is varied. The lateral supports 135, 140 may connect to the vertical supports 130 at junctions 145. The junctions 145 may permit the supports 130, 135, 140 to move radially within the junction so as to compensate for various angles at which the supports 130, 135, 140 are received at the junction 145. The junction 145 may include a multi-directional joint such as a pivotable socket, hinge or bracket. The junction 145 may also include screws or bolts, or another connecting mechanism such as a weld, solder, adhesive or the like for connecting a plurality of the lateral supports 135, 140 to a respective support 130.

A combination of the vertically and laterally extending supports 130, 135, 140 may form a support structure 150. The support structure 150 may be configured to maintain and support a plurality of antennas 105. The antennas 105 may be mounted to the support structure 150 via antenna supports (not shown). The antenna supports may be any type of support configured to hold and maintain an antenna 105 to the support structure 150. The supports may be attached to the lateral supports 135, 140 for maintaining the antenna to each of the lateral supports 135, 140. The supports may include detachable brackets (e.g., including screws or bolts) or another connecting mechanism such as a weld, solder, adhesive or the like configured to receive and lock the antenna 105 to the structure 150. The supports may also be hinged, accordion-like brackets configured to extend laterally from the lateral supports 135, 140.

A collar 170 may be disposed about the post 120 of the center support 110. The collar 170 may be attached to the post 120 by any number of ways such as welded, soldered, screwed, glued using an adhesive or the like. The collar 170 may include a plurality of attachment mechanisms 175, each configured to receive an end of an inner support 180 so that each inner support 180 may extend radially outwardly from the post 120. The attachment mechanism 175 may be hinge-type mechanism configured to allow the attached inner support 180 to move about the post 120. The attachment mechanism 175 may also be socket type mechanism whereby the socket may be configured to receive a ball-like protrusion on the end of the inner support 180.

The inner support 180 may extend radially outwardly from the post 120 of the center support 110 to one of the junctions 145. Thus, the inner supports 180 may connect the support structure 150 to the center support 110. Each of the inner supports 180 may connect to a respective junction 145. Thus, the junction 145 may be configured to receive one of the vertical supports 130, two of the lateral supports 135, 140 and the respective inner support 180. The collar 170 may be located at any point along the post 120. In one example, as shown in FIG. 1, the collar 170 is located midway down the post 120. In another example, as shown in FIG. 2, the collar 170 may be located at the end of the post 120.

Although any quantity of inner supports 180 may be implemented to connect the support structure 150 to the center support 110, the example shown herein is one where the quantity of inner supports 180 is the same as the quantity of vertical supports 130, first lateral supports 135 and second lateral supports 140. As also shown in the figures, the support structure 150 may have a triangular shape. However, the support structure 150 may be configured as any shape such as any polygon. The shape of the support structure 150 may be defined by the quantity of vertical supports 130.

The supports, including the vertical, first lateral, second lateral, and inner supports, 130, 135, 140, 180, as well as the center support 110 and the foundations 190, may be made of galvanized steel or iron. In some cases they may be constructed from a non-ferrous metal such as aluminum. Additionally or alternatively, elements of the support structure 150 may be made of materials such as a plastic for less structural loading.

A foundation 190 may be disposed at a lower end of each of the vertical supports 130 and configured to abut the surface upon which the support structure 150 is placed, e.g., the roof of a building. The foundation 190 may be a non-penetrating surface configured to maintain the support structure 150. The foundation 190 may have a frictional material 200 disposed between the foundation 190 and the surface upon which it is placed to minimize any lateral movement of the structure 150 with respect to the surface. For example, the frictional material 200 may include a rubber or polymeric pad. The material 200 may also be an adhesive material such as a construction adhesive. Such material may prevent the structure 150 from moving or shifting once placed on a surface such as a roof. Additionally or alternatively, the foundation 190 may be attached to the respective surface via other mechanisms such as bolts, screws, etc. The foundation 190 may have a larger diameter than that of the vertical supports 130.

Each of the vertical, first lateral, second lateral and inner supports 130, 135, 140, 180 may include at least two interlocking tubes such as pipes, each tube may be radiused in such a way that one tube may snuggly be received in its larger, mating tube to permit a telescoping lengthening or shortening of the overall tube structure. The two tubes may be locked against telescoping movement by an adjustment mechanism 195. The adjustment mechanism 195 may be an over locking mechanism disposed about an end of the larger tube where the smaller tube is received within the larger, mating tube. For example, the locking mechanism 195 may be a round surround configured to fit tightly around the larger tube. The surround may be tightened around the end of the larger tube and hold the smaller tube in place via the pressure applied to the larger tube.

In another example, the adjustment mechanism 195 may include a cotter type mechanism. A pin or wedge may be configured to lock the two tubes together when inserted into holes defined by the two tubes. For example, the tubes may each define a plurality of holes at a consistent predefined distance from each other. The length of a given support may be adjusted by expanding or retracting one tube with respect to the other tube. Once the desired length has been achieved and at least one of the holes on each of the tubes is aligned, the pin or wedge may be inserted into the aligned holes to maintain the length of the support.

Each support 130, 135, 140, 180 may include more than two tubes wherein each tube receives another tube having a smaller diameter than the respective tube to which it is inserted. Multiple adjustment mechanisms 195 may be used in this configuration to allow each tube to be adjusted to achieve the desired length of the support 130, 135, 140, 180.

The junction 145 may be capable of receiving and maintaining the supports 130, 135, 140, 180 while allowing the supports to move radially at the junction 145 as the lengths and configurations change. Moreover, each pair of first lateral supports 135 and second lateral supports 140 within the support structure 150 may be spaced equidistantly from each other. As described, the height of the vertical support 130 may be adjusted. This adjustment may not affect the distance between the first and second lateral supports 135, 140. This may be the case where the adjustment mechanism 195 of the vertical support 130 is not located between the lateral supports 135, 140, as shown by way of example in FIG. 1. In this instance, the antennas may be maintained on the lateral supports 135, 140 irrespective of the change in height. If the lengths of the lateral supports 135, 140 are to be adjusted, the antennas may be maintained on the supports during such an adjustment. Alternatively, the antennas 105 may be removed and reattached to the lateral supports 135, 140 after they have been adjusted.

In another example, as shown in FIG. 2, where the adjustment mechanism 195 of the vertical support 130 is located between the lateral supports 135, 140, an adjustment to the height of the vertical support 130 may alter the distance between the first and second lateral supports 135, 140. In this instance, the antennas may also need to be adjusted to compensate for the change in distance between the lateral supports 135, 140. The antennas 105 may be easily adjusted if detachable brackets are used as the antenna supports to mount the antennas to the lateral supports 135, 140. The antennas 105 may also be removed and reattached after the height adjustments have been made.

Accordingly, the lengths of each of the supports 130, 135, 140, 180 may be adjusted and readjusted via the adjustment mechanism 195. The shape and dimensions of the support structure 150 may be adjusted once the structure 150 has been placed on a surface such as a roof. Thus, the exact specifications of the antenna platform 100 may not need to be known prior to its installation at the cell site. For example, a roof may be at an incline, and thus, the length of select vertical supports 130 may be adjusted to compensate for the incline while still making sure that the antennas 105 extend outwardly into the sky in the desired orientation to best function.

Figure 4:
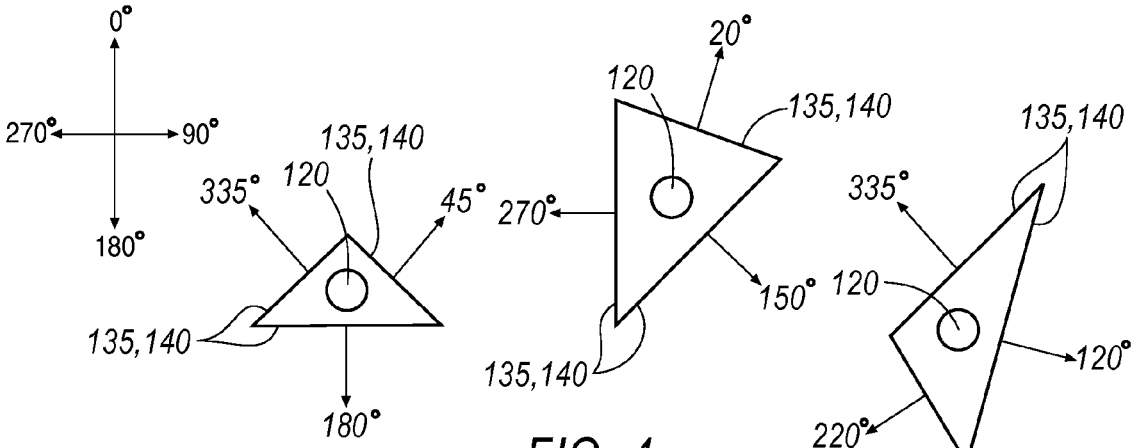
FIG. 4 is an exemplary set of measurements for a portion of an exemplary antenna platform.

FIG. 4 shows exemplary configurations of the lengths of the lateral supports and 135, 140 and the direction of the antennas taken at a top view of the antenna platform 100, similar to FIG. 3. The arrows indicate the radial compass direction at which at least one antenna 105 on each support 135, 140 is facing on a 360 degree scale. By adjusting the lengths of the lateral supports 135, 140, the direction of each antenna 105 may also be adjusted. In one example, the antenna 105 may be facing 140 degrees, 45 degrees and 180 degrees. In another example, the antenna 105 may be facing 140 degrees, 120 degrees and 220 degrees. In the final example shown, the antenna may be facing 150 degrees, 20 degrees and 220 degrees. As explained, these are only exemplary configurations to show that the orientation of at least antennas 105 may be customized, both by adjusting the lengths of the lateral supports 135, 140, as well as rotating the support structure 150 as a whole. When adjusting the lengths of the supports 135, 140, 180, it may be necessary to adjust the different supports in increments so that the overall form of the structure may be achieved. For example, a specific lateral support 135, 140 may not be adjusted to its desired length immediately if it is connected via the junction 145 to an inner support 180 and vertical support 130, which constrains its movement. In this situation, another of the lateral supports 135, 140 may need to be adjusted instead. (e.g., by a few inches). Then, after the respective inner support 180 has also been adjusted, at least a subset of the other lateral supports 135, 140 may be adjusted further. Several iterations of this may be necessary to achieve the desired dimensions. Moreover, the length of the first lateral support 135 may be constrained by the length of the second lateral support 140 and incremental changes in each of the lateral support lengths may be necessary.

By enabling the support structure 150 to be adjusted on-site, specific pre-measurements of the surface of the cell site may not be necessary. Further, if the surface of the cell site is modified, or the location of the support 100 needs to be altered, the structure 150 may easily accommodate such changes without the need to be entirely rebuilt. In the example of the sloped roof, it is ideal to have the antennas 105 mounted perpendicular to the ground. In the event that the antennas 105 are not mounted perpendicular, or entirely vertical, the antennas 105 may feed into each other wherein a signal of one antenna 105 may be overloaded at the front end from the adjacent antenna. Ideally, the antennas 105 would not deviate more than fifteen degrees from perpendicular. By enabling the supports 130, 135, 140, 180, specifically the vertical supports 130, to be adjusted on site, the lateral supports 135, 140 may be placed parallel to the ground, thus enabling the antennas 105 to extend perpendicular thereto.

Figure 5:
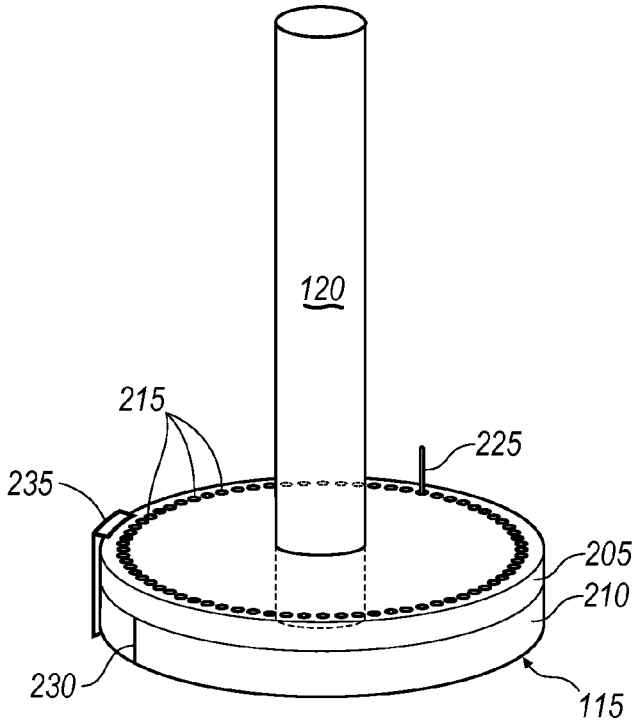
FIG. 5 is an exemplary center support.
Figure 6:
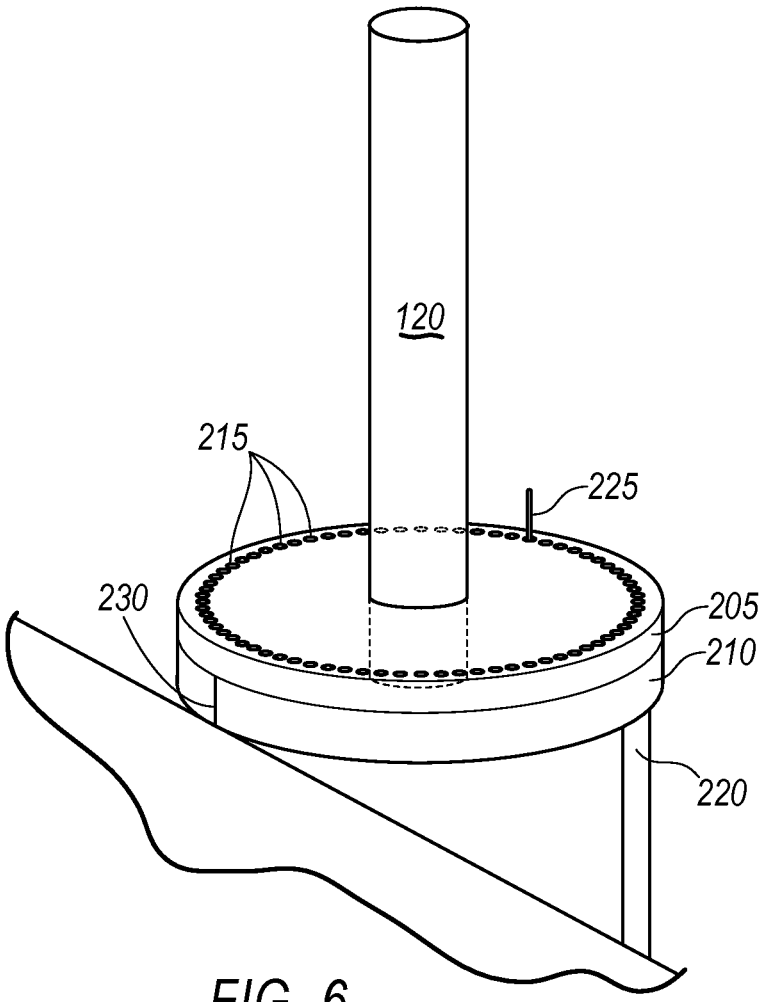
FIG. 6 is the exemplary center support of FIG. 5 including a base support.

FIGS. 5 and 6 show an exemplary center support 110. The post 120 may extend vertically and perpendicularly to the base 115. The base 115 may include a first portion 205 and a second portion 210. The first portion 205 may be configured to receive and fix to the post 120. The second portion 210 may be configured to abut and rest on a surface, such as the roof of a building. The second portion 210 may be generally fixed to the roof and therefore have a fixed orientation. For example, the second portion 210 may be bolted, screwed, welded, soldered or otherwise attached to the surface in order to maintain the location of the second portion 210 with respect to the surface upon which it is placed. The first portion 205 may be configured to rotate about the second portion 210 at a pivot point. The first portion 205 may be connected to the second portion 210 via a connecting mechanism (not shown.) For example, the first and second portions 205, 210 may lock together via a tongue and groove mechanism. The first portion 205 may define a hollow groove extending around the post 120 on the underside of the first portion 205. The second portion 210 may include a tongue extending outwardly at the top side of the second portion 210, aligning with the groove of the first portion 205. Accordingly, the tongue may lock inside the groove of the first portion 205, allowing the two portions 205, 210 to be connected, yet rotatable about each other. While the second portion 210 is attached to a surface, the first portion 205 may be free to rotate, thus rotating the post 120 attached thereto.

Referring to FIG. 6, in the event that the center support 110 is placed on a sloped surface, the base 115 of the center support 110 may be supported by at least one base support 220. The base support 220 may be configured to maintain the base 115 in a level position. The base support 220 may be fixed to the surface and the underside of the second portion 210 of the base 115. The base support 220 may be a post or tube made out of galvanized steel or iron. In some cases the base support 220 may be constructed from a non-ferrous metal such as aluminum or a plastic material.

As shown in FIGS. 5 and 6, each of the first portion 205 and the second portion 210 may define a plurality of holes. The first portion 205 may define first set of holes 215 that extend through the entire portion 205, each hole creating a cylindrical shape running from the top side to the bottom side of the first portion 205. The second portion 210 may define a second set of holes (not shown) at the top side of the second portion 210. The second set of holes may extend from the top side to a midway location on the second portion 210. For example, the second set of holes may extend halfway through the second portion 210. The second set of holes may also extend all the way through the second portion 210, or anywhere therebetween.

The second set of holes may be configured to align with the holes of the first portion 205. The holes may be spaced consistently from one another at a predetermined interval. For example, the holes of the first and second sets, when measured from the center of the post 120, may be 5 radial degrees apart. Thus, each portion may have exactly 72 holes. This is exemplary and the holes may be spaced by any consistent radial degree.

The holes 215 may be configured to receive a locking mechanism 225. The locking mechanism 225 may be a cotter-type mechanism and include a pin, such as a cotter pin, or hook. Once the post is rotated via the first portion 205 to its desired location, the post may be locked in that position by inserting a pin into one of the holes of the first portion 205. The pin may then be received by the corresponding hole of the second portion 210, thus preventing any movement between the first and second portions 205, 210.

As mentioned above, the holes 215 may be spaced at five degree intervals measured from the center of the post 120. Thus, a total of 72 holes would be defined by the base 115, allowing for the post to be rotated in intervals of five degrees. Other exemplary spacing may be implemented such as 36 holes spaced ever ten degrees, and so on. The second portion 210 may include a reference mark 230 to allow for a reference point upon adjustment of the first portion 205.

Other mechanisms for locking the first portion 205 and second portion 210 in place may also be implemented. For example, the first portion 205 may define a plurality of recesses disposed around the periphery of the underside of the first portion 205. These recesses may be spaced equally and align with a plurality of protrusions projecting outwardly from the second portion 210. Thus, by lifting the first portion 205 slightly, the first portion 205 may be lifted off of the protrusions and rotated. Once the rotation was complete and the desired angle of the antennas 105 was achieved, the first portion 205 could then be lowered onto the second portion 210 wherein the recesses receive the protrusions of the second portion 210, locking the first portion 205 to the second portion 210. In another example, a clamp 235 may be placed over both of the portions 205, 210 to maintain the position of the post relative to the second portion 210.

Accordingly, the post 120 of the center support may be rotated and locked into place via the locking mechanism 225. By rotating the post 120, the inner supports 180 are also rotated. The rotation of the inner supports 180 then causes the support structure 150 to rotate, which rotates any and all antennas 105 located on the support structure 150. Thus, the antenna platform 100 may be easily rotated to integrate and tune a cellular site. Typically, antennas 105 may face a predefined direction such as a predefined radial compass point. For example, the predefined direction may be twenty degrees due north. By allowing the support structure 150 to be rotated by the center support 110, all of the antennas 105 supported by the support structure 150 may be adjusted in tandem.

Further, in using the center support 110 to adjust the entire support structure 150, only the post 120 needs to be modified or altered to adjust the entire structure 150. With only the radial location of the post 120 needing modified, the structure 150 may remain intact, as opposed to being disassembled. Further, after a structure 150 has been rotated and adjusted, because the foundations 190 have a minimal effect on the surface on which they are placed, there is typically no need to repair the surface, which requires contractors and roofers, as well as creates down time. Thus, the amount of resources needed to modify the rotation of the antennas 105 is significantly reduced. Additionally, the amount of impact that is felt by the customer is also reduced.

Moreover, multiple cell structures may be adjusted simultaneously or near-simultaneously so as to integrate with adjacent structures. Additionally, because the foundations 190 are not necessarily fixed to a surface, the structure of the surface is maintained and there may not be a need to modify current lease agreements with the building land lords. Certain zoning restrictions may also be avoided, which also require time and resources.

It is to be understood that the above description is intended to be illustrative and not restrictive. Many embodiments and applications other than the examples provided would be apparent upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

What is claimed as new and desired to be protected by Letters Patent of the United States is:

1. An antenna platform comprising:

a support structure having a plurality of vertical supports, a plurality of first lateral supports, and a plurality of second lateral supports, each of the plurality of first lateral supports and each of the plurality of second lateral supports extending between adjacent vertical supports of the plurality of vertical supports, ends of each of the plurality of first lateral supports being connected to the adjacent vertical supports by junctions at respective upper ends of the adjacent vertical supports, and ends of each of the plurality of second lateral supports being connected to the adjacent vertical supports by junctions at respective intermediate locations of the adjacent vertical supports, each of the plurality of first lateral supports and each of the plurality of second lateral supports including at least two interconnecting members and an adjustment mechanism configured to adjust a length of a respective one of the plurality of first lateral supports and the plurality of second lateral supports via the at least two interconnecting members, and the plurality of first lateral supports and the plurality of second lateral supports being configured to have at least one antenna mounted thereon, a shape of a dimension of the support structure being adjustable based on a surface to which the platform is to be attached;

a plurality of inner supports each extending inwardly with respect to the support structure from one of the junctions at the respective upper ends of the adjacent vertical supports;

a center support having a post and a base disposed at one end of the post, wherein the post is configured to receive the plurality of inner supports extending from the support structure, and the base including a first portion and a second portion, the first portion being fixed to the post and completely rotatable with respect to the second portion, wherein upon rotating the first portion, the support structure is rotated via the plurality of inner supports connected to the post while the second portion is fixed to the surface and the center support supports the support structure during a rotation of the first portion.

2. The antenna platform of claim 1, further comprising a locking mechanism configured to prevent the first portion from rotating with respect to the second portion, wherein the first portion defines a set of first holes and the second portion defines a set of second holes configured to align with the set of first holes such that at least one first hole of the set of first holes and a corresponding second hole of the set of second holes are able to receive the locking mechanism, wherein each of the first holes and the second holes is substantially circular.

3. The antenna platform of claim 2, wherein the locking mechanism includes a cotter-type mechanism.

4. The antenna platform of claim 2, wherein the set of first holes extends radially around a perimeter of the first portion, and the set of second holes extends radially around a perimeter of the second portion.

5. The antenna platform of claim 4, wherein immediately adjacent holes of each of the set of first holes and the set of second holes are spaced apart from each other at five degree intervals from a center of the post to a center of each of the immediately adjacent holes.

6. The antenna platform of claim 2, wherein the locking mechanism includes a cotter pin configured to be inserted into one first hole of the set of first holes and one second hole of the set of second holes to lock the first portion to the second portion thereby maintaining the position of the support structure.

7. The antenna platform of claim 2, wherein the locking mechanism is a clamp-type mechanism.

8. The antenna platform of claim 2, wherein each of the set of first holes and the set of second holes includes a plurality of equidistantly spaced holes, the equidistantly spaced holes being spaced equidistant to each other such that each hole of the set of first holes aligns concurrently with a corresponding hole of the set of second holes.

9. The antenna platform of claim 1, further comprising a collar disposed about the post and including connecting mechanisms for receiving the plurality of inner supports.

10. The antenna platform of claim 1, wherein each of the connecting mechanisms is one of a hinge-type mechanism and a socket type mechanism configured to allow each of the plurality of inner supports to move about the post.

11. The antenna platform of claim 1, wherein the plurality of vertical supports are disposed parallel to and radially outward of the center support.

12. The antenna platform of claim 1, wherein the quantity of the inner supports is equal to the quantity of the vertical supports.

13. The antenna platform of claim 1, wherein at least one of the plurality of vertical supports and the plurality of inner supports has an adjustable length.

14. The antenna platform of claim 1, wherein the base has a pivot point and the first portion is rotatable about the pivot point with respect to the second portion.

15. The antenna platform of claim 1, wherein the second portion of the base includes a reference mark.

16. The antenna platform of claim 1, wherein each of the plurality of first lateral supports and a corresponding one of the plurality of second lateral supports are parallel to each other.

17. The antenna platform of claim 1, further comprising a foundation disposed at a lower end of at least one of the plurality of vertical supports, the foundation being configured to abut the surface.

18. The antenna platform of claim 17, wherein the foundation has a frictional material disposed at an underside of the foundation.

19. The antenna platform of claim 1, wherein the junctions are multi-directional joints.

20. An antenna platform comprising:

a support structure having a plurality of vertical supports, a plurality of lateral supports, and a plurality of junctions, at least one of the plurality of lateral supports extending between every two adjacent vertical supports of the plurality of vertical supports, each of the plurality of lateral supports being connected to one of the vertical supports by one of the plurality of junctions, the plurality of lateral supports configured to have at least one antenna mounted thereon, each of the plurality of lateral supports including at least two interconnecting members and a lateral adjustment mechanism configured to adjust a length of a respective one of the plurality of lateral supports via the at least two interconnecting members, and at least one of the vertical supports having a vertical adjustment mechanism configured to adjust a height of the at least one of the vertical supports;

a plurality of inner supports each extending inwardly with respect to the support structure from one of the plurality of junctions;

a plurality of foundations each disposed at a lower end of one of the plurality of vertical supports, each foundation being configured to abut a surface to which the platform is to be attached; and a center support having a post substantially parallel to the plurality of vertical supports and a base disposed at one end of the post, the post being configured to receive the plurality of inner supports extending from the support structure, and the base including a first portion and a second portion, the first portion being fixed to the post and completely rotatable with respect to the second portion, wherein upon rotating the first portion, the support structure is rotated via the plurality of inner supports connected to the post while the second portion is fixed to the surface and the center support supports the support structure during a rotation of the first portion.

* * * * *